US005092987A

United States Patent [19]

Schickel

[11] Patent Number: 5,092,987

[45] Date of Patent: Mar. 3, 1992

[54] MATRIX FOR MAGNETIC SEPARATORS

[75] Inventor: Alfred Schickel, Freiberg, Fed. Rep. of Germany

[73] Assignee: Akademi der Wissenschaften der DDR, Berlin, German Democratic Rep.

[21] Appl. No.: 622,218

[22] Filed: Dec. 3, 1990

Related U.S. Application Data

[63] Continuation of Ser. No. 167,399, Mar. 14, 1988, abandoned.

[51] Int. Cl.[5] ..... B03C 1/00

[52] U.S. Cl. ..... 209/223.1; 209/232; 210/222

[58] Field of Search ..... 209/223.1, 232, 8, 38, 209/39, 213, 214, 215, 223.2, 217; 210/222

[56] References Cited

U.S. PATENT DOCUMENTS

| | | | |
|---|---|---|---|
| 2,154,010 | 4/1959 | Queneau | 209/232 |
| 2,288,264 | 6/1942 | Byrd, Jr. | 209/232 X |
| 2,329,893 | 9/1943 | Girard | 209/232 X |
| 2,760,638 | 8/1956 | Arnett et al. | 210/222 |
| 2,959,287 | 11/1960 | Davis et al. | 210/222 |
| 3,326,374 | 6/1067 | Jones | 209/232 |
| 3,346,116 | 10/1967 | Jones | 210/222 |
| 3,355,024 | 11/1967 | Skoyles et al. | 210/222 |
| 3,581,898 | 6/1971 | Tyrrell | 210/222 |
| 3,850,811 | 11/1974 | Wheelock | 209/223.1 |
| 4,528,096 | 7/1985 | Pfister et al. | 210/222 |

FOREIGN PATENT DOCUMENTS

| | | | |
|---|---|---|---|
| 734785 | 5/1966 | Canada | 209/223.1 |
| 2929468 | 2/1981 | Fed. Rep. of Germany | 210/222 |
| 1022740 | 6/1983 | U.S.S.R. | 209/223.1 |
| 1119732 | 10/1984 | U.S.S.R. | 209/223.1 |
| 1338895 | 9/1987 | U.S.S.R. | 209/213 |
| 17461 | of 1907 | United Kingdom | 209/223.1 |
| 691388 | 5/1953 | United Kingdom | 210/223 |
| 801535 | 9/1958 | United Kingdom | 209/213 |
| 903846 | 8/1962 | United Kingdom | 209/39 |

*Primary Examiner*—Donald T. Hajec

*Attorney, Agent, or Firm*—Schweitzer, Corman & Gross

[57] ABSTRACT

Disclosed is an armature or matrix for a magnetic separator which is to be placed into a magnetic field, for separating paramagnetic components from a particular wet or dry feed, wherein the matrix has a number of low-corrosion or corrosion-free soft magnetic plates disposed parallel to each other and spaced from each other in a direction perpendicular to the magnetic field, nonmagnetic spacers are interposed between the plates, and nonmagnetic ties are used to tie the plates and the spacers together into the matrix.

1 Claim, 1 Drawing Sheet

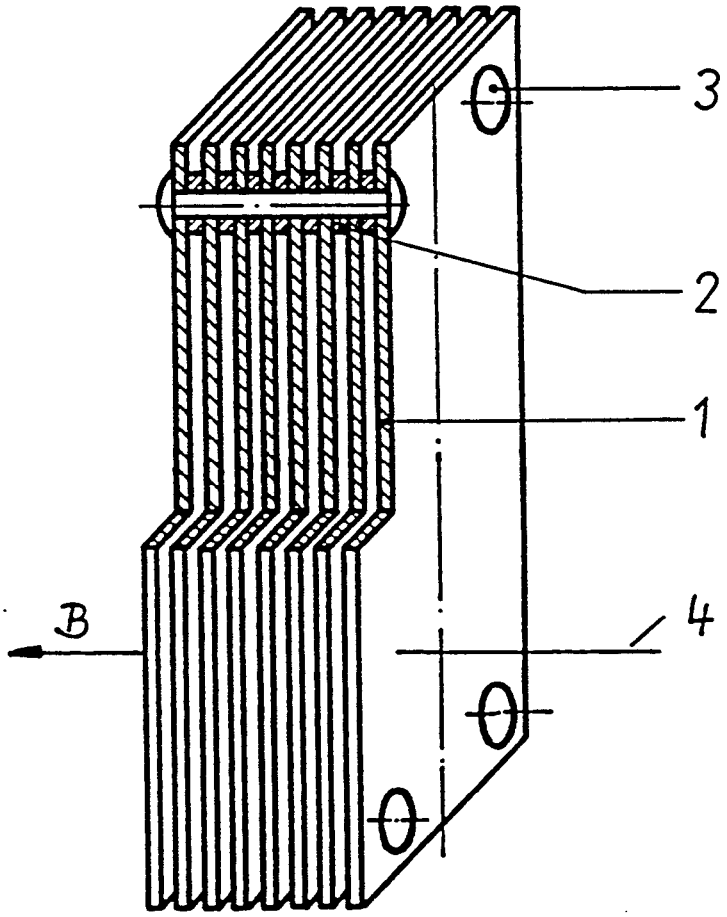
3
2
1
B
4

MATRIX FOR MAGNETIC SEPARATORS

This is a continuing application of U.S. Ser. No. 167,399, filed on Mar. 14, 1988, now abandoned.

FIELD OF THE INVENTION

The invention relates to a matrix for magnetic separators to separate paramagnetic components as well as ferri- and ferromagnetic mixtures from granular piles in wet work and dry work.

BACKGROUND OF THE INVENTION

Matrices for magnetic separators are known, for the separation of paramagnetic components such as hematite, ilmenite, wolframite, biotite, limonite, siderite, etc. from granular piles. Such matrices are used in the familiar induction-body magnetic separators of the most various designs (Jones Magnetic Separator, Humboldt-Wedag; German Fed. Rep. Publ. appln No. 1,132,062; Refining Technology (1973) 3, p. 142–149/Appendix; MIW Magnetic Separator England, Corporate Document of Boxmag-Rapid BR 18, HMC/4000/379; SALA HGMS of Zelesorudne bane Spisska Nova Ves, CSSR, Hornicka Primbram vo vede a technice, Symposium 18–22 Oct. 1982) in the form of strongly magnetizable grooved plates, profiled wires, expanded metal, steel wool, balls, rods, etc. All these matrices have in common that they have induction bodies of arbitrary geometric shape with strong curvatures on their surfaces. Consequently, they create high gradients in external magnetic fields which in turn lead to strong magnetic forces on particles in the neighborhood. The operating principle of these matrices in connection with magnetic separation is based on introducing a feed with a suitable concentration of solids between their induction bodies in the presence of a strong magnetic field. Due to the magnetic field and the high field gradients at the induction bodies, these more strongly paramagnetic, ferrimagnetic and ferromagnetic component of the pulp will deposit, while more weakly paramagnetic and diamagnetic components flow off freely. The magnetic particles adhering to the induction bodies are first washed in the magnetic field whereby an intermediate product is carried off, and after the washing process they are flushed out without a magnetic field, with a flush liquid under high pressure.

Ferromagnetic and ferrimagnetic admixtures in the feed, such as metal scraping or magnetite, sometimes adhere so rigidly to the induction bodies even without a magnetic field that even high water pressure is not sufficient to flush them out. This is caused especially by the remanence in conjunction with the strong curvatures at the surface of the induction bodies, because the residual magnetic force acting on the ferromagnetic and ferrimagnetic admixtures are all unreasonably high. As a consequence, the induction bodies become encrusted and must be cleaned or must be replaced prematurely, since the matrix otherwise blocks magnetically. Both measures require working time and entail considerable costs. Consequently, additional weak-field magnetic separators are frequently connected ahead of the induction bodies magnetic separators in order to separate ferromagnetic and ferrimagnetic admixtures.

Although the expense of reacting and operating these additional units is high, they do not really solve the problem, since the weak-field separators separate only a portion of the strongly magnetic admixtures of the charge material. Consequently, the magnetic blockage of the matrix is only delayed. Another disadvantage is the great space requirement and the need for several separation stages. In one case (German Democratic Republic patent No. 202,638), matrices of non-magnetic separation bodies in the shape of mutually parallel rods and plates, disposed perpendicularly to the field, have been proposed. The non-magnetic separation bodies can also be formed by structures consisting of wires or bulk material. If a charge material fed into such a matrix in a magnetic field, the more strongly magnetizable components of this material are retained in the field direction as chains of polarized particles between the non-magnetic separation bodies that are situated at a suitable distance, while weakly paramagnetic and diamagnetic components flow freely out of the matrix. After the magnetic field has been left behind or has been switched off, the polarization particle chains of paramagnetic particles decompose even if they are contaminated by strongly magnetic particles, and can be flushed out easily. A disadvantage here is that the type of separation remains limited purely to slurries, since the weak adhesive forces between the non-magnetic separation bodies and the polarization chains retain the latter only if they have a low mass, i.e., when their particles are very small. For example, in a matrix consisting of parallel aluminum plates at a 1 mm spacing, with an induction of 1.2T, hematite particles less than 10 $\mu$ can be separated from a pulp. Another disadvantage is that the separation of paramagnetic as well as ferromagnetic components is possible only when they exceed a certain minimum content in the charge, since otherwise no polarization particle chains can form. It is a further deficiency that, with respect to certain induction body matrices (e.g., groove plate-, expanded metal-, and ball matrices), about one furthermore ampere-turns requirement entails higher costs for more electric current and/or higher investment costs for coils with a larger number of windings in the separator.

DESCRIPTION OF THE INVENTION

The invention is based on the aim of assuring the separation of paramagnetic, ferrimagnetic, and ferromagnetic components of the charge material by appropriately designing the magnetic matrix or armature, of essentially eliminating the action of remanence-based residual magnetic forces outside the magnetic field on the separated ferromagnetic and ferrimagnetic particles, of avoiding the limitation of separating only slurries and only the content of magnetic components beyond a certain minimum, as well as of obviating a need for increased ampere-turns. According to the invention, this aim is achieved as described below. In the matrix, low corrosion, preferably corrosion-free soft magnetic plates with a smooth surface are disposed as matrix elements in parallel and spaced from one another, and perpendicularly to the magnetic field of the separator. Thus, the magnetic interaction force of the plates with chains of magnetized particles is not reduced by corrosion layers, and no external magnetic field gradient can arise. The characteristic feature is that the spacing of the soft magnetic plates is determined by non-magnetic spacer elements to prevent a partial magnetic short-circuit between the plates. Another characteristic feature is that the soft magnetic plates are connected through the non-magnetic spacer elements, and the connecting elements are likewise non-magnetic, to prevent a partial magnetic short-circuit between the plates. If the matrix is brought into the approximately homogeneous magnetic field of an inductive magnetic separator, no magnetic field gradient results due to the soft magnetic plates which are oriented perpendicularly to the field and whose surface is smooth. Rather, the field homogeneity is further improved.

If the material being separated is fed into the matrix as a pulp or a dry particles due to the magnetic inter-article interaction forces, and if the nearly homogeneous magnetic field is sufficiently strong, the more strongly paramagnetic components as well as the ferromagnetic and ferrimagnetic components are retained as chains of polarized particles between the soft magnetic plates. On the other hand, more weakly paramagnetic and diamagnetic components flow off from the matrix and are intercepted as a non-magnetic product. The decisive factor here is that the adhesive forces between the soft magnetic plates and the ends of the polarization particle chains are determined by the magnetic dipole forces between the latter at the plates. These forces are of the same order of magnitude as the inter-particle interaction forces. This removes the limitation of separating only slurries. Likewise, the limitation to contents greater than a certain minimum of magnetic components is avoided, since the dipole image forces also retain individual grains at the soft magnetic plates.

The soft magnetic plates in the magnetic field prevent the need for increased ampere-turns, as compared to known inductive matrices, for example those consisting of grooved plates, expanded metal, or balls. Then the magnetic material retained in the matrix is cleaned in the magnetic field by a wash liquid or compressed air, and an intermediate product is collected underneath the matrix. The polarization particle chains then decompose without an external magnetic field. In the remanent magnetic field of the soft magnetic plates, the gradients generated by the magnetic particles themselves and thus the inter-article interaction forces, as well as the dipole image forces, are so small that they can no longer stabilize the polarization particle chains or retain them between the plates. External field gradients are likewise avoided due to the smooth, plate shaped induction bodies. Thus, ferromagnetic and ferrimagnetic particles also are not retained in the matrix when flushing without a magnetic field. The magnetic product is completely discharged by the flush liquid or compressed air.

BRIEF DESCRIPTION OF THE DRAWING

The invention is disclosed in more detail below with reference being had to the sole FIGURE of the drawing. The FIGURE shows in partial cross section the structure of a matrix made of soft magnetic plates.

DESCRIPTION OF A PREFERRED EMBODIMENT

The armature or matrix of the present invention is composed of the soft magnetic plates 1, each of which suitably comprises a corrosion-free, homogeneous chrome steel sheet. The spacing between the plates 1 is maintained by perforated disks 2 made of aluminum. Aluminum rods are used as the connecting elements 3 of the matrix. They extend through aligned holes in the plates 1 as well as through the perforated disks 2, and are riveted at both ends. The outer dimensions of the matrix are chosen so that the matrix fits into the operating boxes of the rotor or canister of an inductive magnetic separator, when the plates 1 are oriented perpendicularly to the magnetic field B. Here, the matrix is at least 15–20 cm high. The spacing of the soft magnetic plates is matched to the particle size and susceptibility of the charge material being processed. For fine particle sizes, it is about 1 mm. The matrix is exposed to the approximately homogeneous magnetic field in the operating box of a rotor or canister of an inductive magnetic separator, and the charge material is fed in as a pulp or as drying particle. If the magnetic induction is sufficient, the more strongly paramagnetic, ferrimagnetic, and ferromagnetic components of the charge material are separated as chains of polarized particles between the soft magnetic plates 1 which are situated perpendicularly to the magnetic field B. On the other hand, more weakly paramagnetic and diamagnetic components flow out from the matrix unaffected and are carried off as non-magnetic products. By washing with a wash liquid or with compressed air, the separated magnetic components are purified, and an intermediate product is carried off. The polarization particle chains decompose and lose their stability without a magnetic field, and are carried off as a magnetic product by a flushing liquid or by compresses air.

In contrast to known matrices with strongly curved surfaces, the matrix of the invention is suited for separating more strongly paramagnetic components without first having to separate ferrimagnetic and ferromagnetic admixtures of the charge material on weak-field separators. The reasons for this is that the chains built up from polarized particles, in which the magnetic force is retained, decompose or lose their stability with the remanence magnetization of the soft magnetic plates 1 and consequently can be carried off completely by the flushing fluid or by compressed air. The high costs and expenditure of labor for cleaning or for premature replacement as well as the associated loss of availability are all eliminated. Furthermore, compared to another known method, the limitation to particulate feed containing magnetic components beyond a certain minimum, as well as the costs for a larger number of ampere-turns due to the use of non-magnetic separation bodies are all eliminated. The matrix consisting of corrosion-free, smooth, soft magnetic plates can be manufactured more simply, with less expenditure of time, and more cheaply than matrices made of grooved plates, profile wires, steel wool, rods, and the like.

I claim:

1. A matrix for a magnetic separator, adapted to be placed into a magnetic field for separating paramagnetic components from a particulate wet or dry feed, consisting essentially of a plurality of low-corrosion or corrosion-free soft; homogeneous magnetic plates having a smooth surface, the plates being disposed substantially parallel to each other in a spaced relative relationship and each plate being disposed substantially perpendicularly to the direction of the magnetic field, a plurality of nonmagnetic spacers disposed alternatingly between said plates for preventing a magnetic short circuit between the plates, and nonmagnetic means for tying said plates and spacers together in a fixed relative relationship in the matrix.

* * * * *